United States Patent [19]

Goodrich

[11] 4,008,850

[45] Feb. 22, 1977

[54] GUSSETED PINCH BOTTOM BAG

[75] Inventor: John J. Goodrich, Rumford, R.I.

[73] Assignee: St. Regis Paper Company, New York, N.Y.

[22] Filed: Feb. 22, 1972

[21] Appl. No.: 228,255

Related U.S. Application Data

[63] Continuation of Ser. No. 169,287, Jan. 29, 1962, abandoned.

[52] U.S. Cl. ..... 229/55; 229/62

[51] Int. Cl.[2] ..... B65D 33/02

[58] Field of Search ..... 229/55, 62, 57, 58, 229/59, 60, 61, 48 T

[56] References Cited

UNITED STATES PATENTS

| | | | |
|---|---|---|---|
| 426,607 | 4/1890 | Single | 229/62 X |
| 1,029,893 | 6/1912 | Sanders | 229/55 |
| 1,983,291 | 12/1934 | Haskell | 229/48 T |
| 2,278,502 | 4/1942 | Waters | 229/48 T |
| 2,316,385 | 4/1943 | Abramson | 229/57 |
| 2,875,944 | 3/1959 | Duffin | 229/55 |
| 3,058,647 | 10/1962 | Reiselt | 229/55 |
| 3,203,620 | 8/1965 | Becker | 229/57 |
| 3,217,970 | 11/1965 | Lokey | 229/62 |
| 3,565,328 | 2/1971 | Hudson | 229/55 |
| 3,650,460 | 3/1972 | Lokey | 229/55 |
| 3,687,356 | 8/1972 | Goodrich et al. | 229/55 |

FOREIGN PATENTS OR APPLICATIONS

| | | | |
|---|---|---|---|
| 680,290 | 8/1939 | Germany | 229/58 |

*Primary Examiner*—Stephen P. Garbe
*Attorney, Agent, or Firm*—Raymond J. McElhannon

[57] ABSTRACT

A sift-proof, leak-proof bag formed from a gusseted, multi-walled tube of paper having stepped plies and bag walls at each end of the tube for attachment to the bag side walls to provide closed bag ends.

1 Claim, 20 Drawing Figures

Fig. 1.
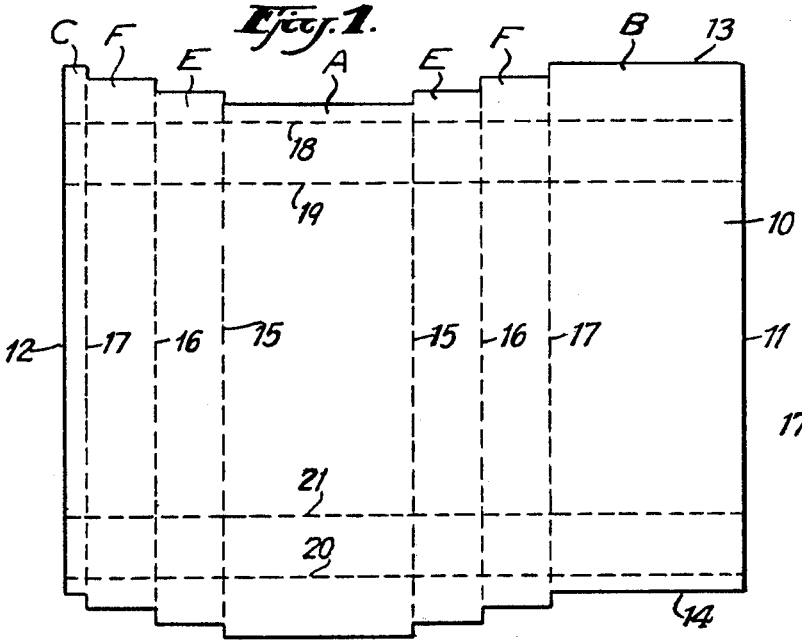
Fig. 8.
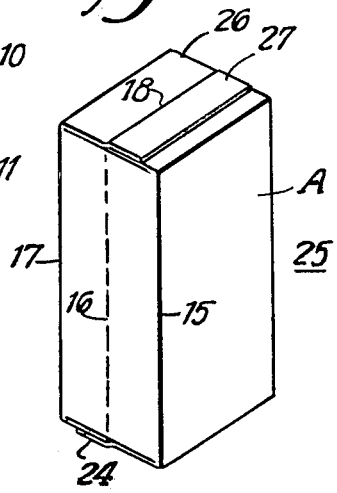
Fig. 2.
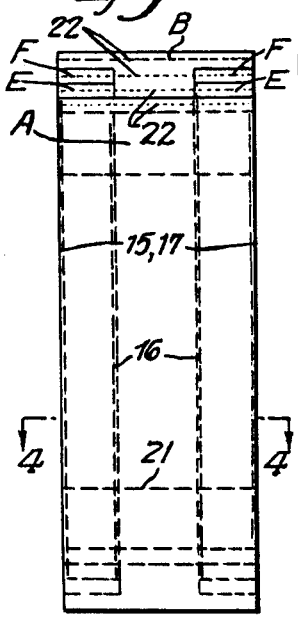
Fig. 3.
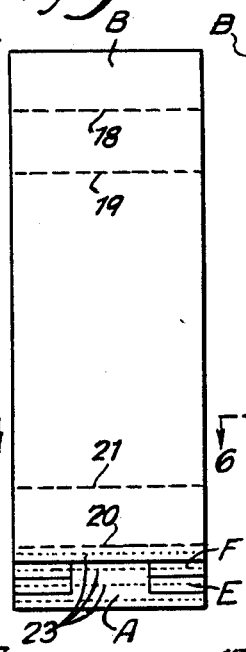
Fig. 5.
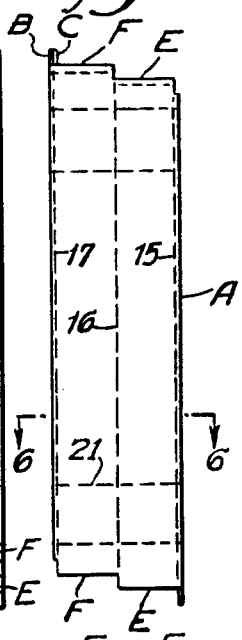
Fig. 7.
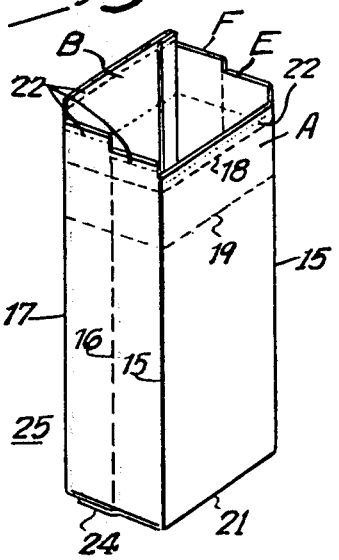
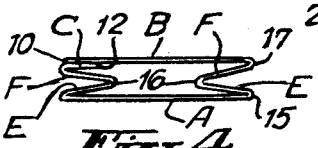
Fig. 4.
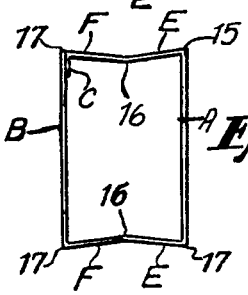
Fig. 6.

Fig. 16.
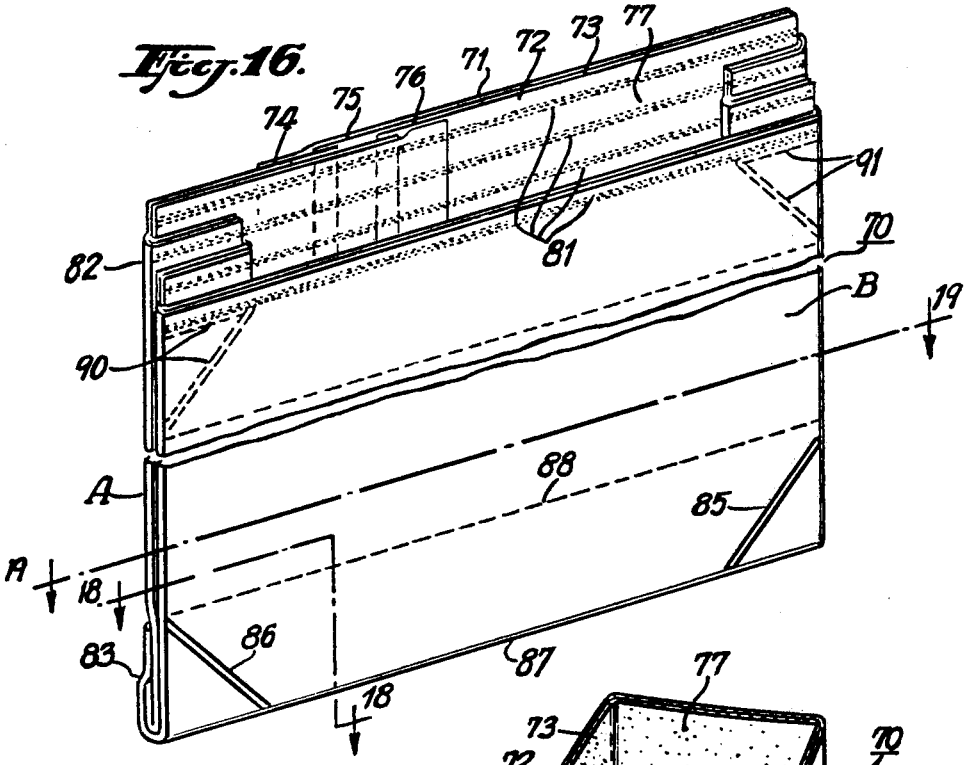
Fig. 17.
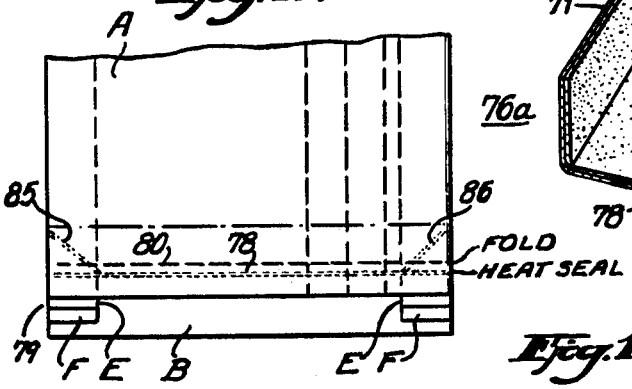
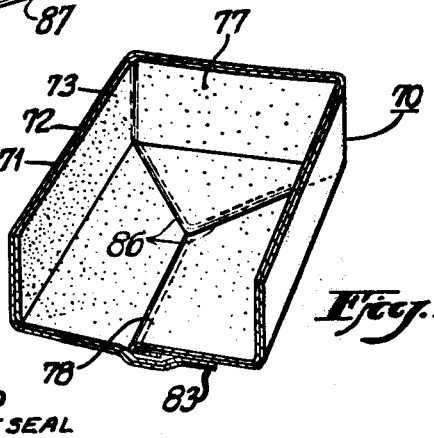
Fig. 18.
Fig. 19.
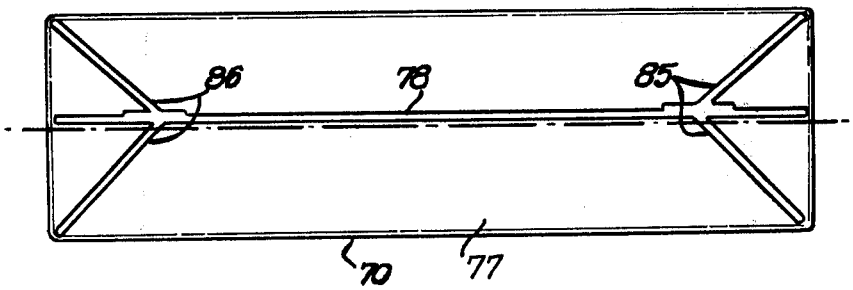

GUSSETED PINCH BOTTOM BAG

This is a continuation of application Ser. No. 169,287, filed Jan. 29, 1962, now abandoned.

This invention pertains to improvements in bags fabricated from flexible sheet material, such as paper or the like, and pertains more particularly to improvements in gusseted bags of the so-called pinch bottom type.

In such bags as heretofore fabricated, the bag is longitudinally gusseted along diametrically opposed portions, by creasing and reversibly folding inwardly, to form a bag tube having substantially rectangular front and rear surface portions between which the gussets are interposed, with one such surface portion overlapping the other at each end of the bag, so that upon forming the bag end closure by folding over one bag end and adherently bonding to a surface portion, both surface portions are adherently bonded to the bag surface to form the closure. In some prior constructions the gussets have either been terminated flush with one of the surface portions at each bag end, or both the front and rear surface portions of each gusset have been overlapped to the same extent within the overlap region of the terminal surface portions.

In accordance with the present invention, however, I have found that a bag of greatly increased strength is obtained by overlapping one portion of each gusset with respect to the other, and terminating both gusset portions within the overlap area between the terminal surface portions at the bag ends. That is to say, in accordance with the bag construction of my invention there is, for example, a progressive stepping at each bag end from one of the surface portions, thence to the contiguous gusset portion, thence to the gusset portion contiguous to the first gusset portion and thence to the opposite surface portion of the bag, the stepping at one end of the bag being in the preferred embodiment, the reverse of or complementary to that at the other end.

The present invention, therefore, provides in accordance with its basic concept, a bag of tubular form which is longitudinally and reversely creased along diametrically opposed portions to provide a pair of oppositely disposed gussets interposed between oppositely disposed surface portions, with one surface portion overlapping the other at each end of the bag, and with one of the opposed portions of each gusset overlapping the other at each bag end and with both portions of each gusset terminating within the overlap area of said surface portions, one end of the bag including the overlap portion being folded against one of said surface portions and being adherently bonded thereto.

The invention may be embodied in bags of single-wall or multi-wall construction. As applied to multi-wall bags, further improvements of the invention are obtained by successively stepping the successive plies at the bag ends, and/or by similarly successively stepping the plies in only the gusseted portions of the bag. In this way, upon forming the bag closure by folding over the bag end and adherently bonding against one of the bag surfaces, all of the bag plies participate and contribute to the bonding action.

In accordance with a further feature of the invention, the surface of the paper forming the interior of the bag in a single-ply bag, or the surface of the bag ply forming the interior of a bag in a multi-wall bag, may have adherently bonded thereto a thin coating of plastic material, such as polyethylene, for moisture-proofing purposes. With respect to bags of this construction, the opposed plastic coated surfaces on the bag interior are bonded by heat sealing transversely across the bag at its base, as supplemental to the normal bag closure aforesaid for additional strengthening and prevention of leakage of the packaged material. Also the transversely extending heat seal may be supplemented in accordance with the invention by additional heat seals extending diagonally across the bag corners at the base, to prevent powdered or granular packaged material from penetrating to the extreme basal corners of the bag, thereby to facilitate emptying the entire contents, and also to facilitate forming the bag base into rectangular configuration when filled with the packaged material. The bag may be similarly heat sealed at the top along the opposite lateral edges by diagonal or angular heat sealing strips. This holds the front and back portions of the gussets together at the top of the bag which has the dual advantages of preventing leakage of the packaged material at the outer extremities of the gussets, and of also facilitating closure of the bag after filling with the packaged material, since it eliminates the necessity for manually tucking in the corners of the bag which would otherwise be required.

Having thus generally described the basic features of the invention, reference will now be had to the accompanying drawings for a more detailed description thereof.

Referring to the drawings:

FIG. 1 shows in plan view a blank of flexible sheet material for fabrication into a single-ply or single-wall bag.

FIGS. 2 and 3, respectively, are the front and rear plan views of a bag tube formed from the blank of FIG. 1, these views showing the bag tube in collapsed form, i.e., with the front and rear surfaces thereof collapsed against the interposed and collapsed gussets.

FIG. 4 is a transverse section at 4—4 of FIG. 2.

FIG. 5 is a side elevation of the bag tube of FIGS. 2–4, inc., in the expanded or distended form of the bag tube.

FIG. 6 is a transverse section at 6—6 of FIG. 5.

FIG. 7 is a perspective view of the bag tube of FIGS. 2–6, inc., but with the base end of the bag tube folded against and adhered to one of the bag surfaces to form the completed bag, closed at the base and open at the top.

FIG. 8 is a perspective view of the bag of FIG. 7, but with the top end of the bag also closed, by folding over the upper end and adhering to one of the bag surfaces.

FIG. 16 is a perspective view of a multi-ply bag in accordance with the invention, the inner surface of the inner ply of which has a thin plastic coating adherently bonded thereto.

FIG. 17 is a fragmentary plan view of the base of the bag of FIG. 16 prior to the bag closure at the base.

FIG. 18 is a section substantially at 18—18 of FIG. 16, this view being in perspective.

FIG. 19 is a sectional plan view taken substantially at 19—19 of FIG. 18.

Figure 9:
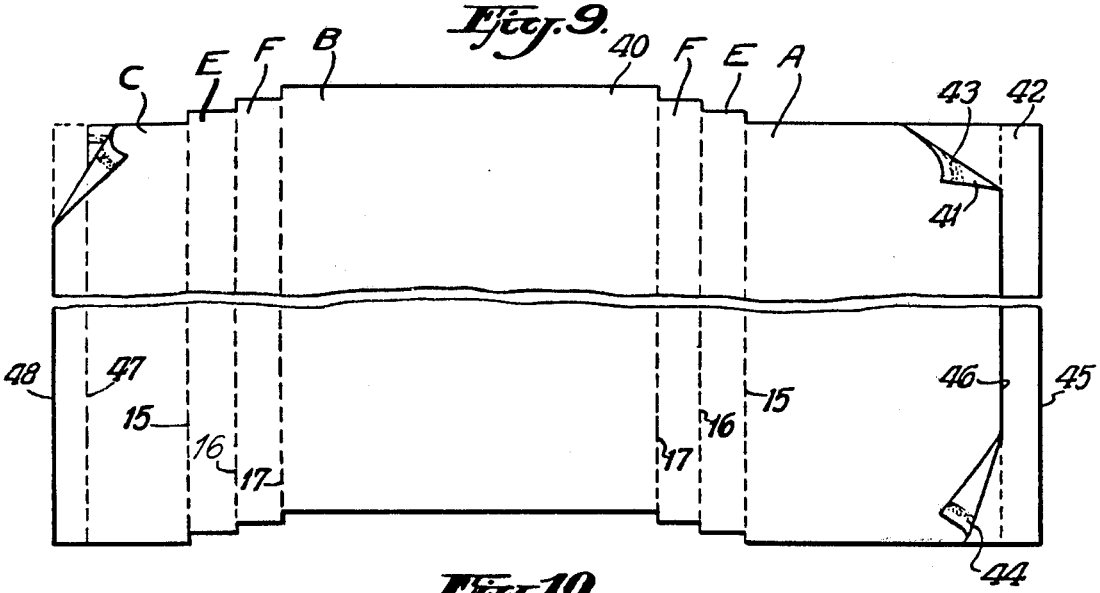
FIG. 9 is a plan view of a multi-ply blank of flexible sheet material for fabrication into a multi-ply or multi-wall bag in accordance with the invention.

Referring to the single wall or ply bag construction of FIGS. 1–8, inc., the bag is formed from a single sheet 10 of a suitable, flexible material, such as kraft or other paper, which may have a thin plastic coating of polyethylene or the like, applied to one or both surfaces thereof for moisture proofing. The sheet 10 is cut to the configuration shown in FIG. 1, with oppositely disposed parallel edges 11, 12, and upper and lower edges 13, 14, of respectively complementary stepped contour, and stepped portions of which define the front and rear surfaces A and B, respectively, of the finished bag, a sealing flap C and interposed front and rear gusset areas E, F. More specifically, the top edge is stepped successively down by equal amounts from the rear surface B to the rear gusset portion F, thence to the front gusset portion E and thence to the front surface A. The lower edge 14 is stepped up in the reverse order and complementary to the top edge.

In addition, the sheet 10 is creased parallel to the edges 11, 12, at the limits of the respective gusset portions E, F, as at 15, 16, 17, is also creased transversely near the top and bottom, as at 18, 19 and 20, 21.

Referring to FIGS. 2 and 3, the sheet 10 of FIG. 1 is reversely folded along the crease lines 15–17, inc., to form the gussets E, F, in the manner most clearly shown in FIG. 4, which brings the flap C into underlying relation with respect to rear surface B adjacent the marginal edge 10 thereof, along which the flap C is sealed to the underside of surface B to form the bag tube as shown collapsed in FIGS. 2–4, inc., and distended or expanded in FIGS. 5 and 6.

Referring to FIGS. 2 and 3, it will now be observed that at the top of the bag tube thus formed, the front portion E of each gusset is stepped up with respect to the front surface A, the rear portion F of each gusset is stepped up with respect to the front portion E thereof, and that the rear surface B of the bag is stepped up with respect to the rear portion F of the gusset. It will be further observed that at the bottom of the bag tube, the same stepping occurs to the same extents in the reverse order from the front to rear surfaces A and B, as shown by comparison at FIGS. 2 and 3.

Adhesive is applied to the thus stepped portions of the bag tube, as at 22, 23. The bottom of the tube is now folded upon itself along the fold line 20 and the adhesive bearing stepped portions thus sealed against the rear surface B of the tube, as at 24, FIG. 7, thereby to form the open-ended bag shown generally at 25. FIG. 7 shows the bag in expanded condition and of rectangular configuration due to bending at the base along the horizontal and diagonal crease line 21.

When the bag is filled with a material to be packed, it is closed along the crease line 19 into the rectangular configuration shown at 26 in FIG. 8, to provide a closure flap 27, which is folded down along the fold line 18, and sealed to the front surface A of the bag by means of the adhesive 22, thus to give a closed bag of over-all block-like contour.

Referring now to FIGS. 9–14, inc., which illustrate the steps in fabricating a multi-wall, or multi-ply bag in accordance with the invention, the procedure is essentially the same as for the single-wall or single-ply bag of FIGS. 1–8, inc. FIGS. 9–14, inc., show the fabrication of a multi-wall bag consisting of two thicknesses or two plies of paper, but it will be understood that the same procedure applies to three-ply bags or those containing any higher number of plies.

As shown in FIG. 9, the blank 40 from which the bag is formed is composed of two thicknesses 41, 42, of sheet material such as kraft paper, glued together as at 43, 44, with a staggered overlap along the lateral edges, as at 45, 46 and 47, 48, with the under ply 42 extending beyond the upper ply 41 at the right-hand margin in the drawings and vice versa along the left-hand margin.

The so laminated plies are otherwise blanked out along the upper and lower margins in the same manner as the single ply blank 10 of FIG. 1, to form front and rear surfaces A and B, respectively, of the fabricated bag, together with a sealing flap C and interposed front and rear gusset portions E and F, which are successively stepped between the front and rear surfaces A and B in the same manner as above explained with reference to the like designated portions of FIG. 1.

Figure 10:
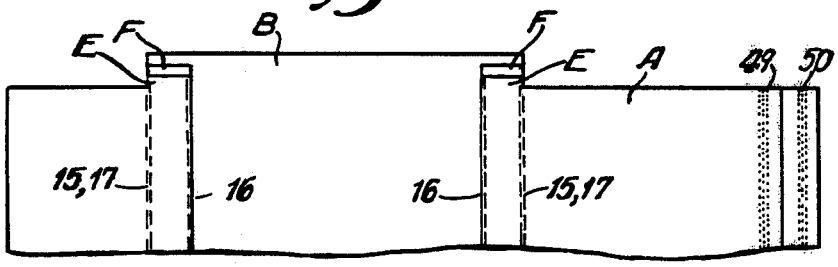
FIG. 10 is a fragmentary plan view of a portion of the FIG. 9 blank, illustrating the first step of forming the same into a bag by reversely folding longitudinally along the gusset crease line to form the bag gussets.
Figure 11:
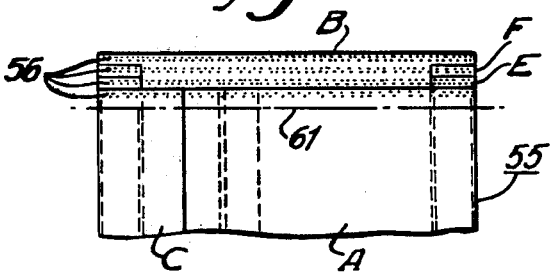
FIG. 11 is a fragmentary plan view of the completed bag tube as fabricated from the FIG. 10 showing.
Figure 12:
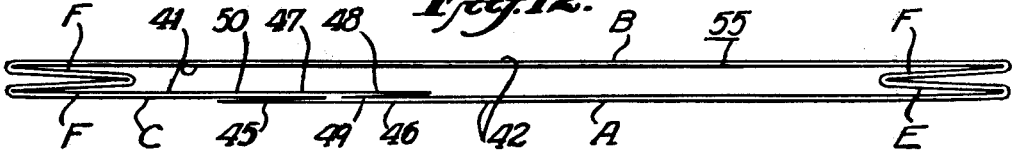
FIG. 12 is an enlarged view in end elevation of the FIG. 11 showing.

As shown in FIG. 10, the gusset portions E and F are reversely folded along the vertical crease lines 15–17, inc., of FIG. 9, first inwardly against surface B along crease lines 17, thence outwardly along crease lines 16, and thence inwardly along crease line 15, thereby, referring now to FIGS. 11 and 12, to bring the edge 47, 48, of the sealing flap C under the edges 45, 46, of the front surface A, with the exposed edge 48 of the ply 41 lapping the opposite edge 46 thereof and being sealed thereto by an interposed adhesive 49, and with the exposed edge 45 of ply 42 lapping the opposite edge 47 thereof and being adhesively bonded thereto, as at 50.

The blank 40 of FIG. 9 is thus formed into the multi-wall, gusseted tube shown generally at 55 of FIGS. 11 and 12, in which, referring to FIG. 11, the front gusset portions E are stepped up at the top of the tube with respect to the front surface A, and wherein the rear gusset portions F are stepped up with respect to the front gusset portion E, and the rear surface B of the tube further stepped up with respect to the rear gusset portions F as shown. At the base of the tube the stepping is in the reverse order, as shown in FIG. 13.

Figure 15:
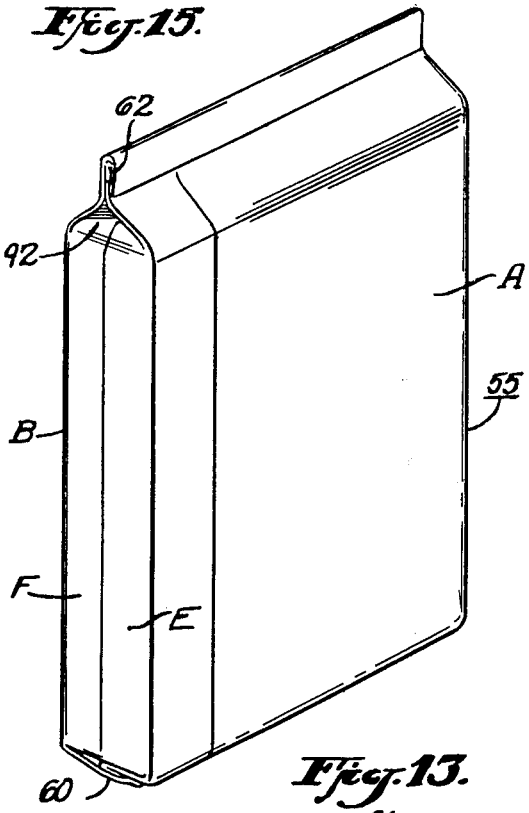
FIG. 15 is a perspective view of the bag of FIG. 14, as also closed at the top.
Figure 14:
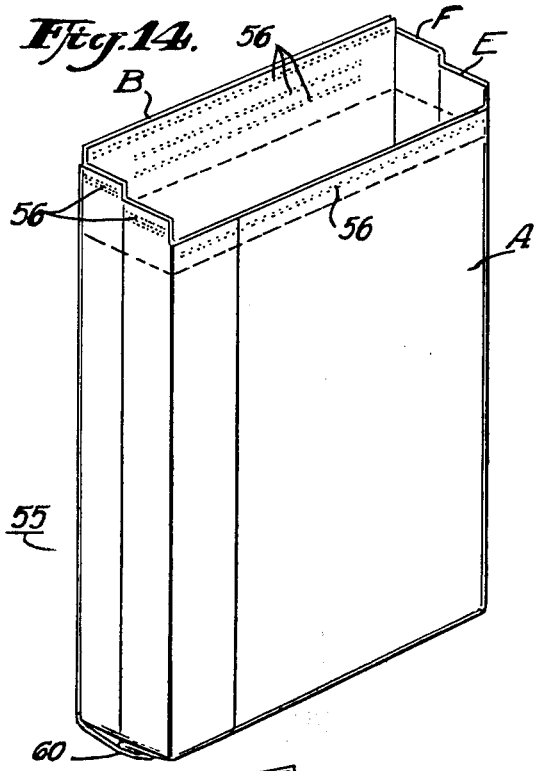
FIG. 14 is a perspective view of the bag of FIG. 13 after closure at the base.
Figure 13:
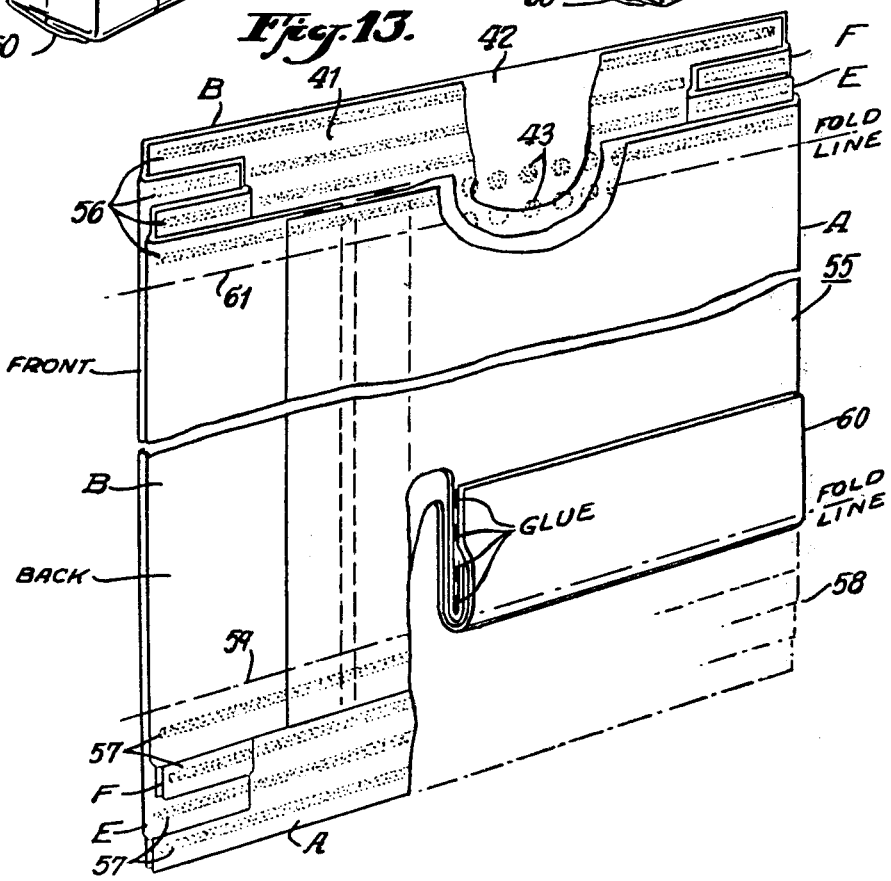
FIG. 13 is a perspective view of the bag tube of FIG. 11, illustrating the manner of folding over the base and adhering to one of the bag surfaces to form a bag closure at the base.

Adhesive is now applied to the stepped portions over the areas 56, 57, FIGS. 11 and 13, and the base portion 58, FIG. 13, folded over along the fold line 59, and sealed against the back wall B, as at 60, to form a bag closure to give the open-ended, multi-wall bag shown in FIG. 14, which may be closed at the top by folding along the fold line 61, FIGS. 11 and 13, and sealing against the front wall A, as at 62, FIG. 15.

Referring now to FIGS. 16–21, inc., there is shown a three-ply multi-wall bag 70 fabricated in the same manner as the two-ply bag of FIGS. 9–15, inc., previously explained. In the construction of FIGS. 16–21, inc., the bag plies 71–73, are overlapped along their respective lateral marginal edges, and the thus overlapped edges sealed together, as at 74–76, to form the multi-ply bag tube 76*a*, FIG. 17, with front and rear surfaces A and B, and interposed stepped gussets E, F.

In this embodiment of the invention, the inner ply 73 has adherently bonded to its inner surface, a thin coating 77 of a plastic material, such as polyethylene, for moisture proofing. Referring to FIG. 17, the plastic coated inner surface of the inner ply is in face-to-face contact with respect to the portions of the front and rear surfaces A and B over contiguous areas thereof, and the same is true of the gusset portions E and F with respect to the front and back surface portions A and B, respectively. This permits of forming a heat sealed closure at the base of the tube 76*a*, by applying heat and pressure along the line 78, 85, 86, thus to heat seal the aforesaid opposed plastic surfaces together. The bag closure is thereupon completed by folding the stepped end, basal portion 79, along the fold line 80 and against the front bag surface A, and bonding the thus opposed surfaces together by means of glue previously applied to the lower stepped tube end, in the same manner as is illustrated at 81, FIG. 16, for the stepped top tube end 82, and thereby completing the closure at the bottom of the tube in the manner shown at 83, FIG. 16. Accordingly, when the bag is opened up and flattened out at the base, it will have the rectangular configuration shown in FIGS. 18 and 19, presenting an unbroken plastic coated interior 77, heat sealed along the seams 78, 86.

Still referring to FIG. 16, the bag may optionally be heat sealed at the top along the opposite lateral edges in accordance with the angular shaped heat seals 90 and 91. This holds the front and back portions E, F, of the gussets together at the top of the bag which has the dual advantage (1) of preventing leakage of the packaged material at the outer extremities of the gussets, and (2) of facilitating closure of the bag after filling with packaged material since it eliminates the necessity for manually tucking in the corners of the bag, as at 92, FIG. 15, which would otherwise be required.

Referring to the multi-wall bag constructions of FIGS. 9–19, inc., the bag plies may be successively stepped at the bag ends to provide additional adherence on forming the bag closure. Thus, referring to FIG. 9, the under ply 42 may be stepped upwardly with respect to the bag ply 41, thus to provide an overlap at the bag ends between the plies 41 and 42. Such stepping of the bag plies not only provides an overlap of one with respect to the other in the surface portions A, B at the ends of the bag, but also in the gusset areas E, F as well. In this way, portions of all of the bag plies both in the surface areas A, B and in the gusset areas E, F will, upon forming the bag closure by folding over along the fold line and adhesively bonding to the bag surface, be adherently bonded to the bag surface.

Figure 20:
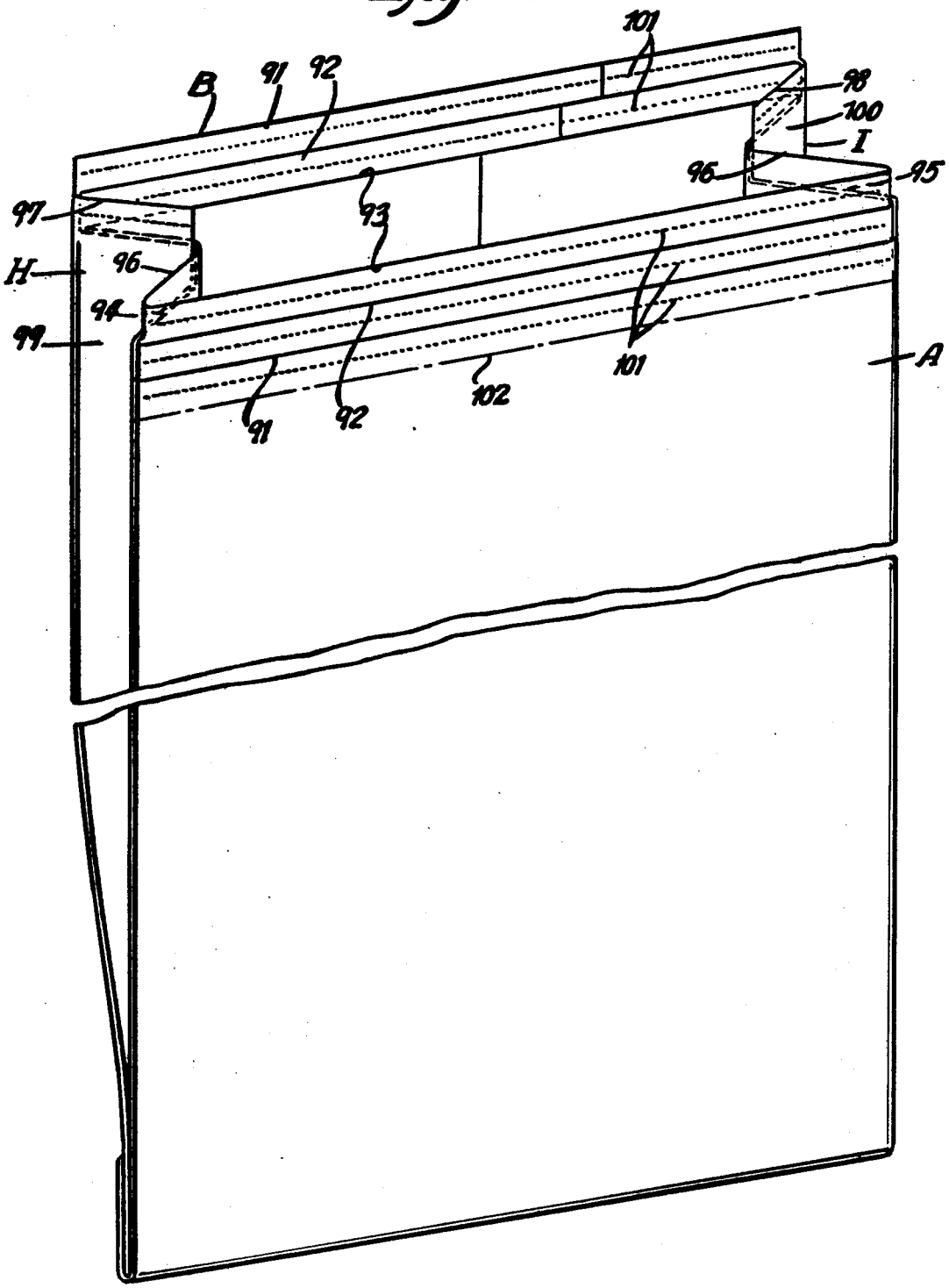
FIG. 20 is a perspective view of a multi-ply bag in accordance with that embodiment of the invention wherein the plies are successively stepped at the bag ends.

FIG. 20 shows a three-ply bag of this construction the plies of which are shown at 91–93, inc. The front and rear bag portions are shown at A and B, respectively, and the gussets at H and I. It will be seen that in the front bag portion A, the middle and inner plies 92 and 93 are successively stepped up at the top of the bag with respect to the outer ply 91; and that in the rear bag portion B, the middle and outer plies are successively stepped up with respect to the inner ply 93, the front and rear portions of which latter are stepped to the same extent with respect to the front portion of the outer ply 91 and such as to bisect the extent to which the rear portion of the outer ply overlaps the front portion thereof. In the gusset portions H and I, the outer ply 91 extends to the height 94, 95 of the front gusset portions 96, and to the height 97, 98, in the rear gusset portions 99, 100, corresponding to that of the rear surface portion of the middle ply 92. It will be understood, however, that other steppings of the gusset portions may be employed. For forming the bag closure, adhesive is applied to the various stepped portions, as at 101, and the closure is made by folding the end along the fold crease 102 thus to adhere the bag end to the outer ply of the front surface portion A.

In order to demonstrate the superior strength of bags according to the present invention in which, referring to the multi-wall bag of FIG. 13, the front and rear gusset portions are successively stepped with respect to each other, as at E and F, to different intermediate distances within the overlap of the rear surface B with respect to the front surface A, as compared to bags otherwise similarly constructed except for extension of both the front and rear portions of each gusset to the same intermediate distance midway of said overlap, bags of each type were made up and tested in the manner and with results as follows:

In a first series of tests, three-ply bags of each type were made up from natural kraft paper of total basis weight 180 pounds, i.e., 180 pounds per ream of paper. Sixteen bags of each type containing 100 pounds of salt were dropped from progressively increasing heights, starting with 24 inches and increasing by 6 inch increments until all bags of each series had broken in the drop test. The heights at which individual bags of each series broke were then averaged for the 16 bags of each type tested with results as follows:

| Type of Gusset in Bags | Average Height In Inches of Drop Test Producing Breakage of All Bags |
|---|---|
| Flush cut | 171 |
| Stepped cut (The invention) | 291 |

In a similar series of tests conducted on three-ply bags made of natural kraft paper of 160 pounds total basis weight, the following results were obtained on the drop test: flush cut gusseted bags 132 inches; stepped cut gusseted bags 229 inches. On a rerun of this series of tests using 16 additional bags of each type, the results were: flush cut gussets 180 inches; stepped cut gussets 292 inches.

In a similar series of tests using two-ply bags of extensible or slightly creped natural kraft paper of total basis weight 120 pounds, the results were: flush cut gussets 180 inches; stepped cut gussets 292 inches.

In a similar series of tests using two-ply bags of the extensible or slightly creped natural kraft paper of total basis weight, 140 pounds, the results were: flush cut gussets 231 inches; stepped cut gussets 294 inches.

It will be seen from the above test results that in each series of tests, the bags having the stepped cut gussets according to the prevent invention were far superior to those with the flush cut gussets, as regards the height from which the bags could be dropped without breakage. The average such height for the bags having the stepped cut gussets ranged from 28 to 66 percent greater than for similar bags having the flush cut gussets.

What is claimed is:

1. A bag of tubular form comprising a plurality of plies of flexible sheet material, said bag having a front surface and an oppositely disposed rear surface with the rear surface adapted to overlap said front surface in assembled relationship, said bag being longitudinally and reversely creased along diametrically opposed portions to provide a pair of oppositely disposed gussets, each gusset comprising front and rear gusset portions interposed between said front and rear surfaces and connected thereto to form said tube, said plies being successively stepped with respect to each other to form said rear surface and reversibly stepped with respect to each other to form said front surface at each end of said tube, and selected plies being stepped in a first direction with respect to each other in said front gusset portions and in a reverse direction in said rear gusset portions at each end of said tube, and one end of said tube including all of said plies being folded against said front surface and adherently secured in position.

* * * * *

Dedication 4,008,850.—*John J. Goodrich*, Rumford, R.I. GUSSETED PINCH BOTTOM BAG. Patent dated Feb. 22, 1977. Dedication filed May 8, 1978, by the assignee, *St. Regis Paper Company.*

Hereby dedicates to the Citizens of the United States of America the remaining term of said patent.

[*Official Gazette August 29, 1978.*]